US007627272B2

(12) United States Patent
Iwamura

(10) Patent No.: US 7,627,272 B2
(45) Date of Patent: Dec. 1, 2009

(54) DEVELOPER TRANSPORT DEVICE, DEVELOPING DEVICE, VISIBLE IMAGE FORMING DEVICE AND IMAGE FORMING APPARATUS

(75) Inventor: Takuya Iwamura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 200 days.

(21) Appl. No.: 11/822,237

(22) Filed: Jul. 3, 2007

(65) Prior Publication Data

US 2008/0145105 A1 Jun. 19, 2008

(30) Foreign Application Priority Data

Dec. 18, 2006 (JP) ..... 2006-339623

(51) Int. Cl.
*G03G 15/08* (2006.01)
*G03G 15/04* (2006.01)
*G03G 21/00* (2006.01)

(52) U.S. Cl. ..... 399/254; 399/253; 399/255; 399/256; 399/258; 399/260; 399/262; 399/263; 399/103; 399/98; 399/119

(58) Field of Classification Search ..... 399/254, 399/260, 253, 98, 255, 256, 263, 258, 103, 399/119, 262
See application file for complete search history.

(56) References Cited

U.S. PATENT DOCUMENTS

| | | | | |
|---|---|---|---|---|
| 5,249,020 | A * | 9/1993 | Takano | 399/260 |
| 5,572,299 | A * | 11/1996 | Kato et al. | 399/256 |
| 5,943,537 | A * | 8/1999 | Ahn | 399/254 |
| 2001/0033757 | A1* | 10/2001 | Sato | 399/103 |
| 2005/0196184 | A1* | 9/2005 | Koyama et al. | 399/27 |
| 2008/0232858 | A1* | 9/2008 | Uematsu | 399/254 |

FOREIGN PATENT DOCUMENTS

| | | |
|---|---|---|
| JP | A 3-080272 | 4/1991 |
| JP | A 11-65250 | 3/1999 |
| JP | A 11-212345 | 8/1999 |
| JP | A 2006-195356 | 7/2006 |

* cited by examiner

*Primary Examiner*—David M Gray
*Assistant Examiner*—Rodney Bonnette
(74) *Attorney, Agent, or Firm*—Oliff & Berridge, PLC

(57) ABSTRACT

A developer transport device includes: a developer containing room for containing a developer; a developer transport member disposed in the developer containing room, the developer transport member transporting the developer in a developer transport direction; and a developer damming member disposed in the developer containing room over the developer transport member, the developer damming member damming up the developer located above the developer transport member.

11 Claims, 10 Drawing Sheets

DEVELOPER TRANSPORT DEVICE, DEVELOPING DEVICE, VISIBLE IMAGE FORMING DEVICE AND IMAGE FORMING APPARATUS

CROSS-REFERENCE TO RELATED APPLICATION

This application is based on and claims priority under 35 USC §119 from Japanese Patent Application No. 2006-339623 filed Dec. 18, 2006.

BACKGROUND (i) Technical Field

The present invention relates to a developer transport device, a developing device, a visible image forming device, and an image forming apparatus.

(ii) Related Art

In an image forming apparatus in the related art, such as electrophotographic copiers and printers, image formation is performed in such a manner that a developer holding body is opposed to a photoreceptor body on whose surface a latent image is formed and the latent image is visualized with a developer that is carried by the surface of the developer holding body.

For example, a two-component developer containing a toner and a carrier is used as the developer. The two-component developer is agitated until it is transported to the developer holding body, whereby lumps of toner are broken up and the tuner and the carrier are charged through friction.

The developer is consumed by image formation and hence requires supply. Furthermore, the developer holding body and the photoreceptor body are deteriorated as they are used, and hence need to be replaced when they have been used for a certain length of time. Therefore, in the image forming apparatus, a developer supply container (what is called a toner cartridge) is made replaceable (detachable) to supply only a developer, the developing device and the photoreceptor body are made replaceable, or the developer supply container and the developing device are integrated with each other so as to be replaced together. These measures are employed widely. In general, such a replaceable developing device is sealed so as to prevent the developer from leaking during storage or transport. When used, such a replaceable developing device is unsealed so as to be rendered usable by causing the developer to flow into the developing device.

SUMMARY

According to an aspect of the invention, there is provided an developer transport device comprising:

a developer containing room for containing a developer;

a developer transport member disposed in the developer containing room, the developer transport member transporting the developer in a developer transport direction; and a developer damming member disposed in the developer containing room over the developer transport member, the developer damming member damming up the developer located above the developer transport member.

BRIEF DESCRIPTION OF THE DRAWINGS

Embodiments of the present invention will be described in detail based on the following figures, wherein:

FIG. 3A illustrates a state that it is in use, and FIG. 3B illustrates a state before opening of an initial developer containing room;

FIG. 5A is a side view and FIG. 5B is a sectional view illustrating an important part;

FIG. 6A illustrates a state that the developer damming member is held at a contained position, and FIG. 6B illustrates a state that the developer damming member is removed;

FIG. 7A is a front view and FIG. 7B is a view as viewed from the direction of arrow VIIB in FIG. 7A;

FIGS. 9A and 9B are a front view and a side view corresponding to FIGS. 7A and 7B of the first embodiment, respectively; and FIG. 10 illustrates a developer damming member according to a third exemplary embodiment of the invention.

DETAILED DESCRIPTION

Figure 1:
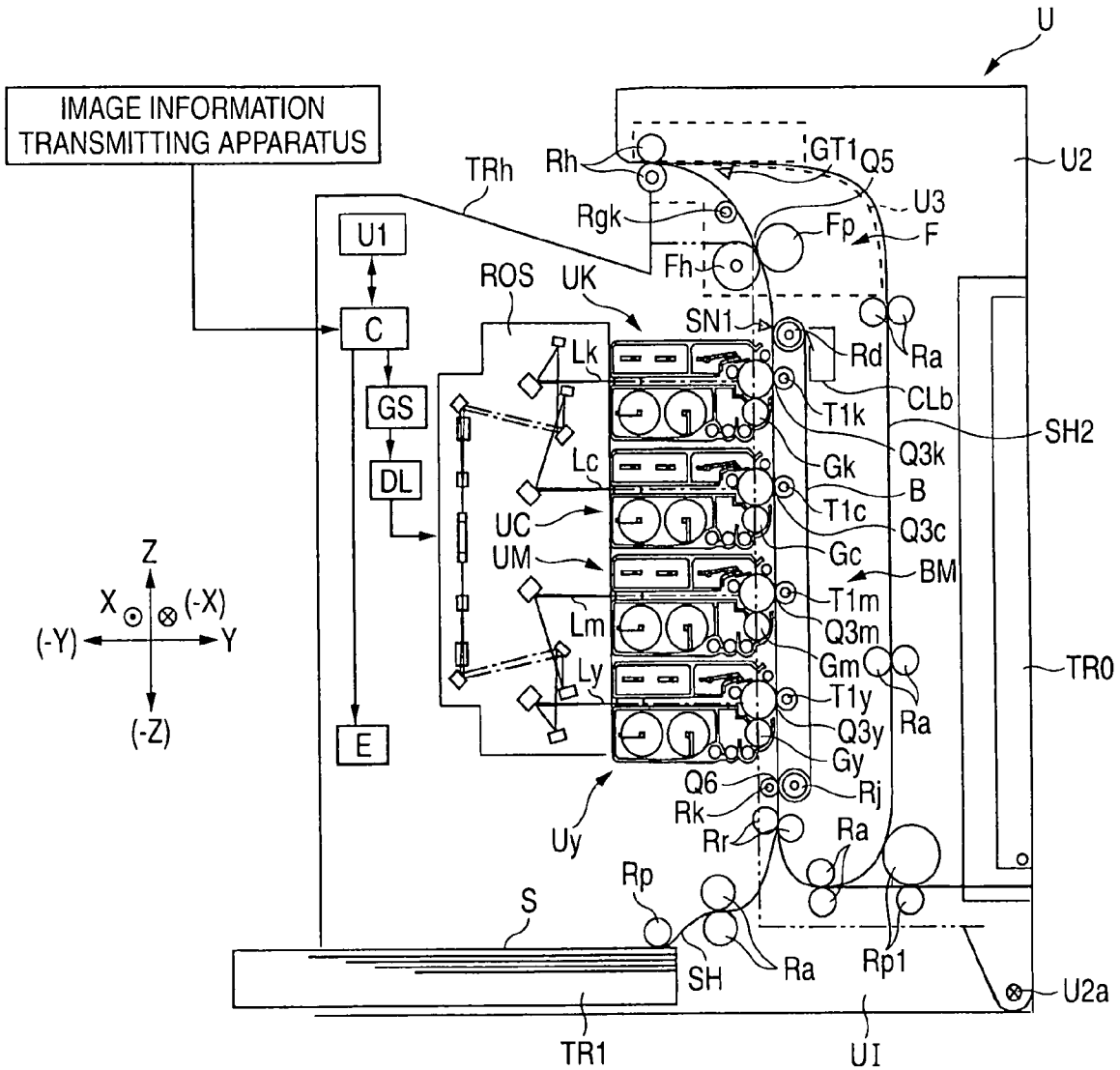
FIG. 1 illustrates the whole of an image forming apparatus according to a first exemplary embodiment of the present invention.

Exemplary embodiments of the present invention (hereinafter referred to as embodiments) will be hereinafter described with reference to the drawings. However, the invention is not limited to the following embodiments.

To facilitate the understanding of the following description, in the drawings, the X-axis direction, the Y-axis direction, and the Z-axis direction are defined as the front-rear direction, the right-left direction, and the top-bottom direction, respectively. And the directions (sides) indicated by arrows X, −X, Y, −Y, Z, and −Z are defined as the front direction (side), the rear direction (side), the right direction (side), the left direction (side), the top direction (side), and the bottom direction (side), respectively.

In the drawings, the mark that "•" is enclosed by a circle means an arrow that is directed from the back side to the front side of the paper surface and the mark that "x" is enclosed by a circle means an arrow that is directed from the front side to the back side of the paper surface.

To facilitate the understanding of descriptions which will be made with reference to the drawings, members that are not necessary for the descriptions will be omitted where appropriate.

Embodiment 1

FIG. 1 illustrates the whole of an image forming apparatus according to a first exemplary embodiment of the present invention.

Figure 2:
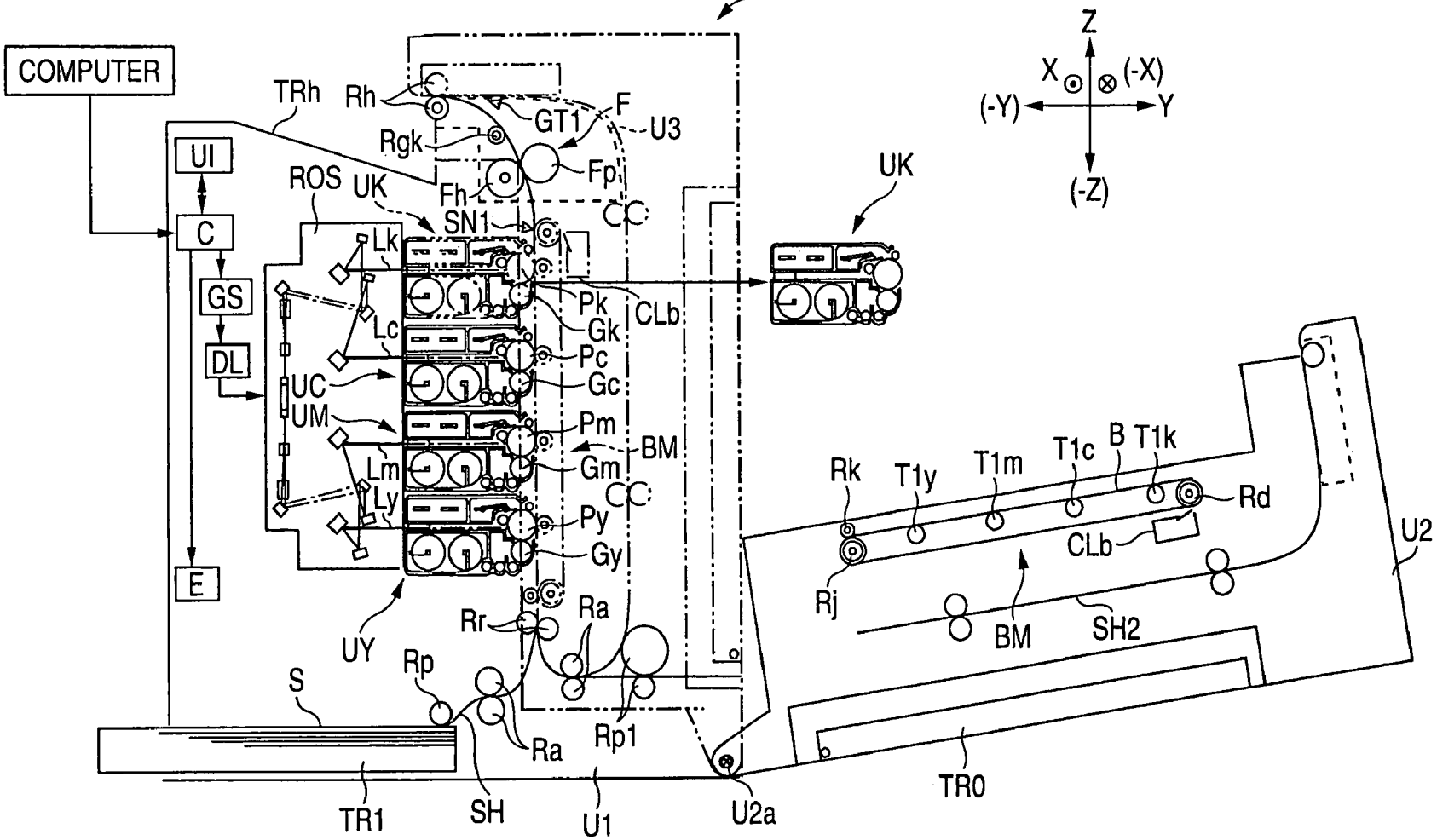
FIG. 2 illustrates the image forming apparatus according to the first embodiment of the invention in a state that an open/close unit is opened.

FIG. 2 illustrates the image forming apparatus according to the first embodiment of the invention in a state that an open/close unit is opened.

As shown in FIG. 1, in a printer U as an exemplary image forming apparatus according to the first embodiment of the invention, a sheet supply tray TR1 which contains recording media S as exemplary media on which images will be recorded occupies a lower portion of the printer U and a sheet ejection unit TRh includes a top surface of the printer U. A manipulation unit UI is disposed at a top position of the printer U.

As shown in FIGS. 1 and 2, the printer U according to the first embodiment has an image forming apparatus main body U1 and an open/close unit U2 which can be opened and closed about a rotation shaft U2*a* which are located at the bottom-right corner of the image forming apparatus main body U1. The open/close unit U2 is configured so as to be movable between an open position (indicated by solid lines in FIG. 2) for exposing the inside of the image forming apparatus main body U1 to enable supply of a developer, replacement of a member in failure, or removal of a jammed recording medium S and a closed position (indicated by two-dot chain lines in FIGS. 1 and 2) where the open/close unit U2 is held in an ordinary state in which an image forming operation is performed.

The printer U has a control section C' which performs various controls on the printer U, an image processing section GS whose operation is controlled by the control section C, an image writing device drive circuit DL, a power device E, etc. The power device E applies voltages to charging rollers DRy-CRk as exemplary chargers (described later), developing rollers G1*y*-G1*k* as exemplary developer holding bodies, transfer rollers T1*y*-T1*k* as exemplary transfer devices, etc. (these components will be described later).

The image processing section GS converts print information that is input from an external image information transmitting apparatus or the like into pieces of latent image forming image information corresponding to images of four colors of K (black), Y (yellow), M (magenta), and C (cyan), and outputs the pieces of image information to the image writing device drive circuit DL with prescribed timing. The image writing device drive circuit DL outputs drive signals to a latent image writing device ROS according to the received pieces of image information of the respective colors. According to the drive signals, the latent image writing device ROS emits laser beams Ly, Lm, Lc, and Lk as exemplary image writing light beams of the respective colors.

As shown in FIG. 1, visible image forming devices UY, UM, UC, and UK for forming toner images as exemplary visible images of the respective colors of Y, M, C, and K are disposed on the right (+Y direction) of the latent image writing device ROS.

Figure 3A:
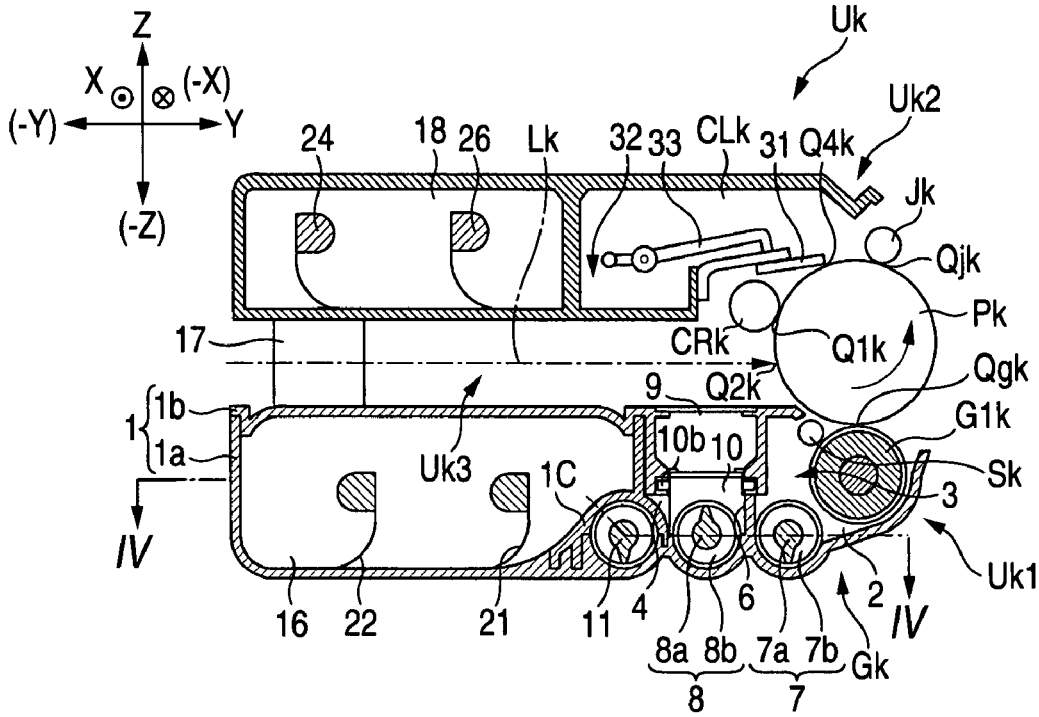
FIGS. 3A and 3B illustrate a visible image forming device as an exemplary detachable body according to the first embodiment of the invention.
Figure 3B:
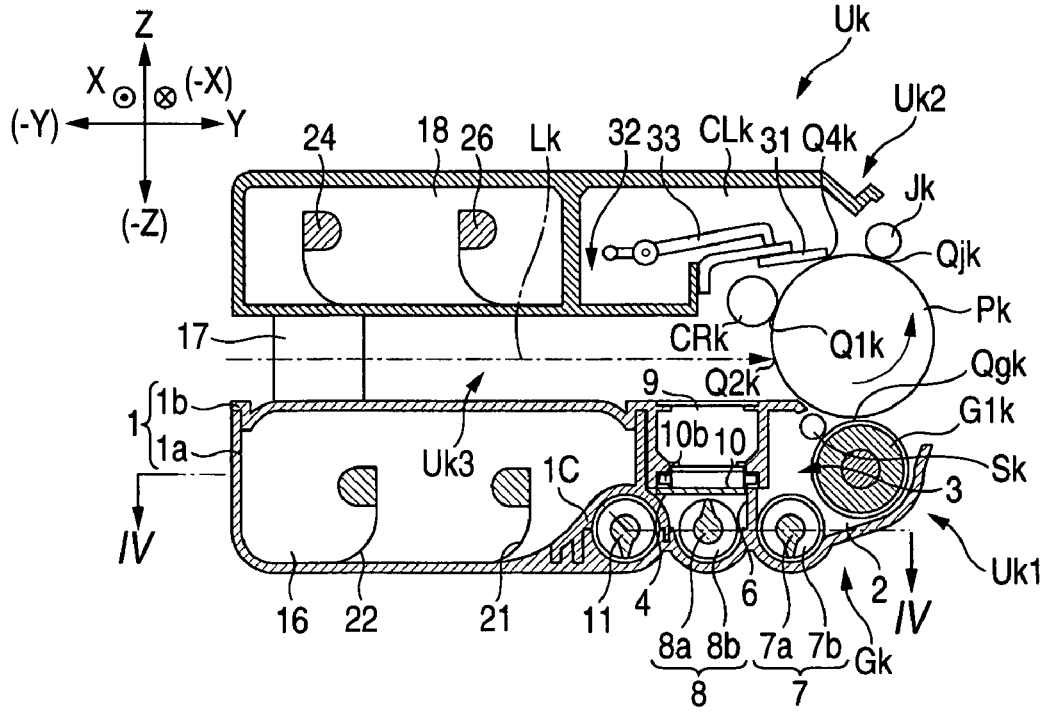

FIGS. 3A and 3B illustrate one visible image forming device as an exemplary detachable body according to the first embodiment of the invention. FIG. 3A illustrates a state that it is in use, and FIG. 3B illustrates a state before opening of an initial developer containing room.

As shown in FIGS. 3A and 3B, the visible image forming device UK of K (black) has a photoreceptor body Pk as an exemplary rotary image holding body. A charging roll CRk as an exemplary charger, a developing device Gk for developing a latent image on the surface of the photoreceptor body Pk into a visible image, a charge removing member Jk for removing charge from the surface of the photoreceptor body Pk, a photoreceptor body cleaner CLk as an exemplary image holding body cleaner for removing developer remaining on the surface of the photoreceptor body Pk, etc. are disposed around the photoreceptor body Pk.

After the surface of the photoreceptor body Pk is charged up uniformly as a result of charging by the charging roll CRk at a charging region Q1*k* which is opposed to the charging roll CRk, a latent image is written to the photoreceptor body Pk at a latent image forming region Q2*k* with a laser beam Lk. The thus-written latent image is visualized at a development region Qgk which is opposed to the developing device Gk.

The visible image forming device UK of black according to the first embodiment is a detachable body (what is called a process cartridge) in which the photoreceptor body Pk, the charger CRk, the developing device Gk, the charge removing member Jk, the photoreceptor body cleaner CLk, a developer supply container (11+16+18), etc. are integrated together. As shown in FIG. 2, the visible image forming device UK is configured so as to be able to be attached to and detached from the image forming apparatus main body U1 in a state that the open/close unit U2 is moved to the open position.

Like the visible image forming device UK of black, the visible image forming devices UY, UM, and UC of the other colors (yellow, magenta, and cyan) are detachable bodies (what is called process cartridges) which can be attached to and detached from the image forming apparatus main body U1. While each of the visible image forming devices UY, UM, and UC is not separately illustrated, each visible image forming device UY, UM, and UC would be identical to the visible image forming device UK illustrated in FIGS. 3A and 3B, with each element indicated by the letter "k" for black being changed to "y", "m", and "c" for the colors yellow, magenta, and cyan. FIGS. 1 and 2 show the arrangement of each visible image device UK, UY, UM, and UC with respect to each other.

As shown in FIGS. 1 and 2, a belt module BM as an exemplary recording medium transport device supported by the open/close unit U2 is disposed on the right of the photoreceptor bodies Py-Pk. The belt module BM has a medium transport belt B as an exemplary recording medium holding transport member, a belt drive roll Rd as an exemplary drive member which supports the medium transport belt B, belt support rolls (Rd+Rj) as an exemplary holding transport member support system including a follower roll Rj as a follower member, transfer rolls T1*y*, T1*m*, T1*c*, and T1*k* as exemplary transfer devices which are opposed to the respective photoreceptor bodies Py-Pk, an image density sensor SN1 as an exemplary image density detecting member, a belt cleaner CLb as an exemplary holding transport member cleaner, and a medium absorbing roll Rk as an exemplary recording medium absorbing member which is opposed to the follower roll Rj and absorbs a recording medium S on the medium transport belt B. The medium transport belt B is rotatably supported by the belt support rolls (Rd+Rj). The image density sensor SN1 detects, with prescribed timing, the density of a density detection image (what is called a patch image) which is formed by an image density adjusting means (not shown) of the control section C. The image density adjusting means performs an image density adjustment or correction (what is called a process control) by adjusting the voltages applied to the chargers CRy-CRk, the developing devices Gy-Gk, and the transfer rolls T1*y*-T1*k* and the intensities of latent image writing light beams Ly-Lk on the basis of the image density detected by the image density detecting member.

A recording sheet S is taken by a sheet feed member Rp from the sheet supply tray TR1 which is located below the medium transport belt B, and is transported to a recording medium transport path SH.

In the recording medium transport path SH, the recording medium S is transported by medium transport rolls Ra as exemplary recording medium transport members and thereby sent to registration rolls Rr as exemplary sheet supply timing adjusting members. The registration rolls Rr transport, with prescribed timing, the recording medium S to a recording medium absorbing position (region) Q6 where the follower roll Rj and the medium absorbing roll Rk are opposed to each other. The recording medium S that has been transported to the recording medium absorbing position Q6 is electrostatically absorbed on the medium transport belt B.

Where a recording medium S is supplied from a manual feed unit TRO, a recording medium S supplied through manual feed members Rp1 is transported to the registration rolls Rr by medium transport rolls Ra and then transported to the medium transport belt B.

The recording medium S which is absorbed on the medium transport belt B passes transfer regions Q3*y*, Q3*m*, Q3*c*, and Q3*k* in order where the medium transport belt B is in contact with the photoreceptor bodies Py-Pk, respectively.

At each of the transfer regions Q3*y*, Q3*m*, Q3*c*, and Q3*k*, a transfer voltage whose polarity is opposite to the toner charging polarity is applied, with prescribed timing, to the transfer roll T1*y*, T1*m*, T1*c*, or T1*k* from the power device E which is controlled by the control section C.

In the case of forming a multi-color image, toner images on the respective photoreceptor bodies Py-Pk are transferred in superimposition to the recording medium S placed on the medium transport belt B by the transfer rolls T1*y*, T1*m*, T1*c*, and T1*k*. In the case of forming a single-color image (monochrome image), only a toner image of K (black) is formed on the photoreceptor body Pk and transferred to the recording medium S by the transfer device T1*k*.

After charges are removed from the surfaces of the photoreceptor bodies Py-Pk by the charge removing members Jy-Jk at charge removing regions Qjy-Qjk, toner remaining on the surfaces of the photoreceptor bodies Py-Pk is collected by the photoreceptor body cleaners CLy-CLk at cleaning regions Q4*y*-Q4*k* to clean the surfaces. Then, the surfaces of the photoreceptor bodies Py-Pk are charged up again by the charging rolls CRy-CRk.

The recording medium S to which the toner images have been transferred are subjected fusing at a fusing region Q5 where a heating roll Fh and a pressure roll Fp as exemplary heating fusing members of a fusing device F are in pressure contact with each other. The recording medium S on which the image has been fused is guided by a guide roller Rgk as an exemplary guide member and ejected to the medium ejection unit TRh as an exemplary medium ejection member through ejection rollers Rh.

After separation of the recording medium S, the medium transport belt B is cleaned by the belt cleaner CLb.

In the case of double-sided printing, the ejection rollers Rh are driven so as to be rotated reversely and the recording medium S is transported to a medium flipping path SH2 by means of a switching member GT1. The recording medium S is sent to the registration rolls Rr again in a flipped state.

In the first embodiment, the fusing device F, the lower ejection roll (drive roll) Rh, the switching member GT1, and the lower guide surface of the medium flipping path SH2 constitute an integrated, replaceable fusing device (what is called a fusing unit U3). The upper ejection roll (follower member) Rh is supported by the open/close unit U2.

(Visible Image Forming Device)

Figure 4:
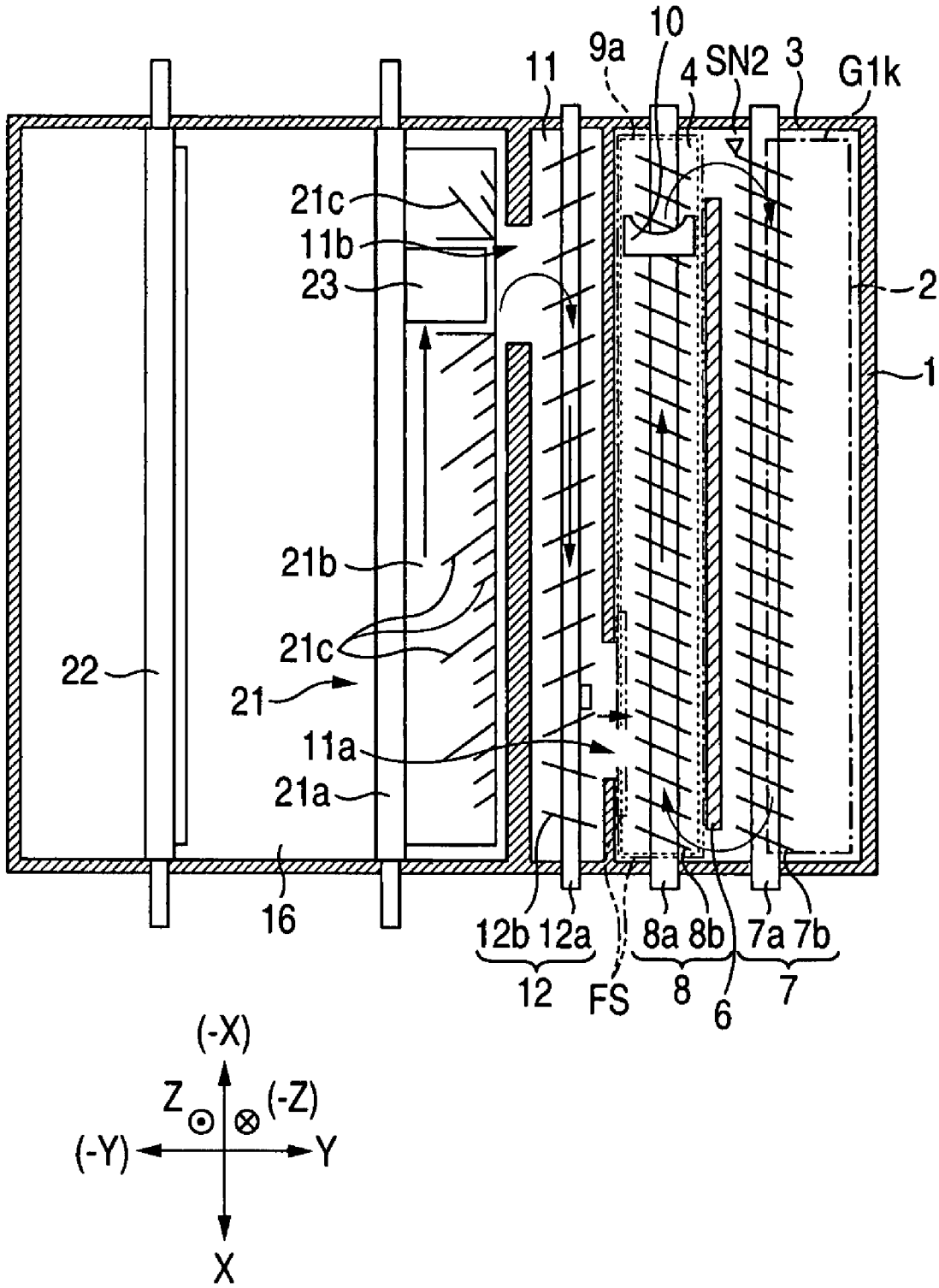
FIG. 4 is a sectional view taken along line IV-IV in FIG. 3.

FIG. 4 is a sectional view taken along line IV-IV in FIGS. 3A and 3B.

The visible image forming devices UY-UK will be described below in detail. Since the visible image forming devices UY-UK of the respective colors are configured in the same manner, only the visible image forming device UK of black will be described, that is, descriptions of the other visible image forming devices UY, UM, and UC will be omitted.

As shown in FIGS. 3A and 3B and 4, the visible image forming device UK is configured in such a manner that a developing unit Uk1 having the photoreceptor body Pk and the developing device Gk and a cleaning and charging unit Uk2 having the charging roll CRk, the photoreceptor body cleaner CLk, and the charge removing roll Jk are assembled. A writing light passage Uk3 through which a laser beam Lk is to pass is formed between the developing unit Uk1 and the cleaning and charging unit Uk2.

The developing unit Uk1 has a developer container 1 which contains a developer. The developer container 1 has a lower developer container main body 1*a*, a lid member 1*b* which closes the developer container main body 1*a* from above, and a central partition member 1*c* which forms a developer transport room (described later) by partitioning the developer container main body 1*a* at a central position in the right-left direction.

The developer container 1 has a developer holding body containing room 2 which supports the developing roll G1*k* as an exemplary developer holding body which is opposed to the photoreceptor body Pk, a first agitation transport room 3 which is adjacent to the developer holding body containing room 2 from the left side and contains a developer, and a second agitation transport room 4 which is adjacent to the first agitation transport room 3 from the left side. A layer thickness restricting member Sk for restricting the layer thickness (i.e., the thickness of developer carried by the surface of the developing roll G1*k*) is disposed in the developer holding body containing room 2 so as to be opposed to the developing roll G1*k*.

The first agitation transport room 3 and the second agitation transport room 4 as an exemplary developer containing room are separated from each other by a partition wall 6. The first agitation transport room 3 and the second agitation transport room 4 are configured so that developer can move between them at both ends in the front-rear direction.

A two-component developer containing a toner and a carrier is contained as the developer in the developer container 1 according to the first embodiment. The developer holding body containing room 2, the first agitation transport room 3, and the second agitation transport room 4 constitute the developer containing room (2-4).

As shown in FIG. 4, a toner density sensor SN2 as an exemplary developer density detecting member is disposed at the rear end of the first agitation transport room 3, that is, at the upstream end in the developer transport direction, to detect a toner/carrier mixing ratio (what is called a toner density).

Agitation transfer members 7 and 8 as exemplary developer transport members for transporting developer in opposite directions while agitating it are disposed in the first agitation transport room 3 and the second agitation transport room 4, respectively. The agitation transport members (augers) 7 and 8 according to the first embodiment are composed of rotary shafts 7*a* and 8*a* and spiral transport blades 7*b* and 8*b* which are fixedly supported by the rotary shafts 7*a* and 8*a*, respectively.

As for the agitation transport members 7 and 8 according to the first embodiment, the diameter of the rotary shafts 7*a* and 8*a* is 4 mm, the spiral diameter (i.e., the outer diameter of the transport blades 7*b* and 8*b*) is 8 mm, the pitch which is the axial advancement per rotation of the transport blades 7*b* and 8*b* is 15 mm, and the rotation speed is set at 408.39 rpm. These values may be changed arbitrarily according to the design.

Figure 5A:
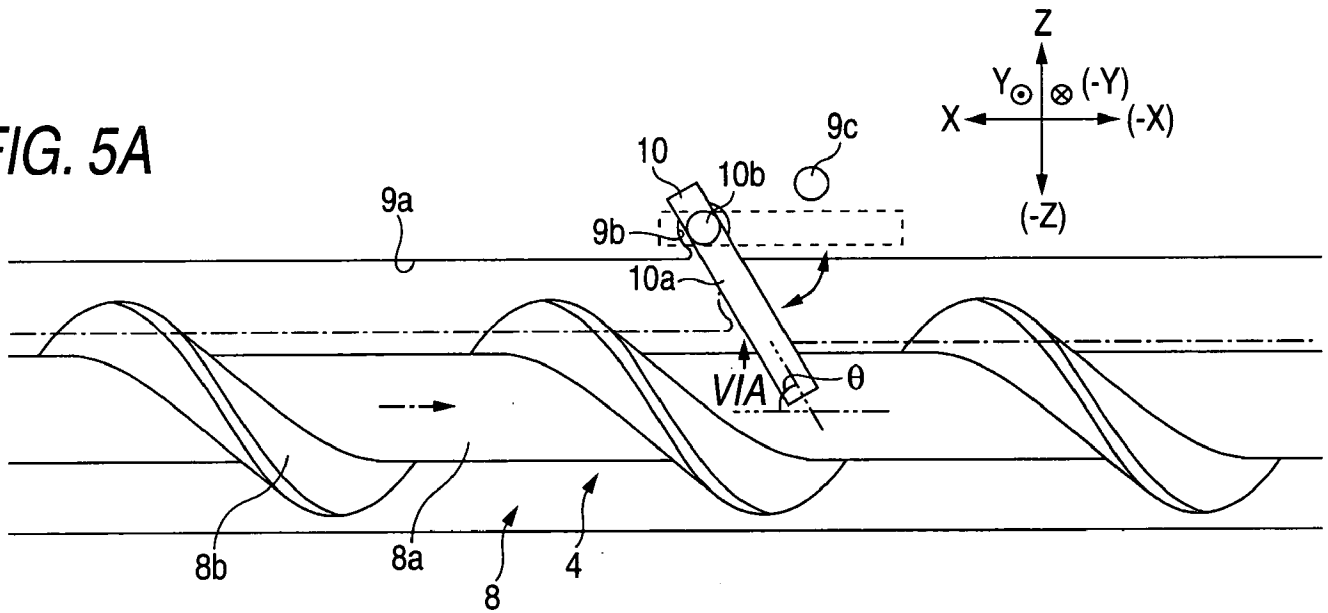
FIGS. 5A and 5B illustrate a developer transport member and a developer damming member according to the first embodiment of the invention.
Figure 5B:
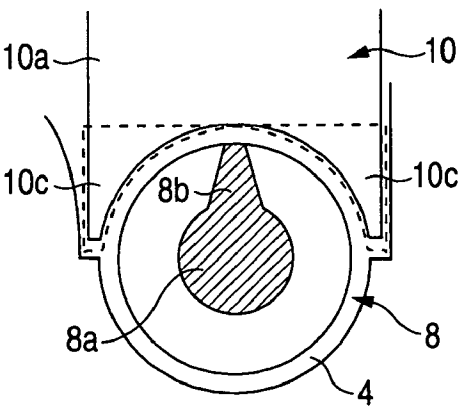

FIGS. 5A and 5B illustrate the developer transport member 8 and a developer damming member according to the first embodiment of the invention. FIG. 5A is a side view and FIG. 5B is a sectional view illustrating an important part.

Figure 6B:
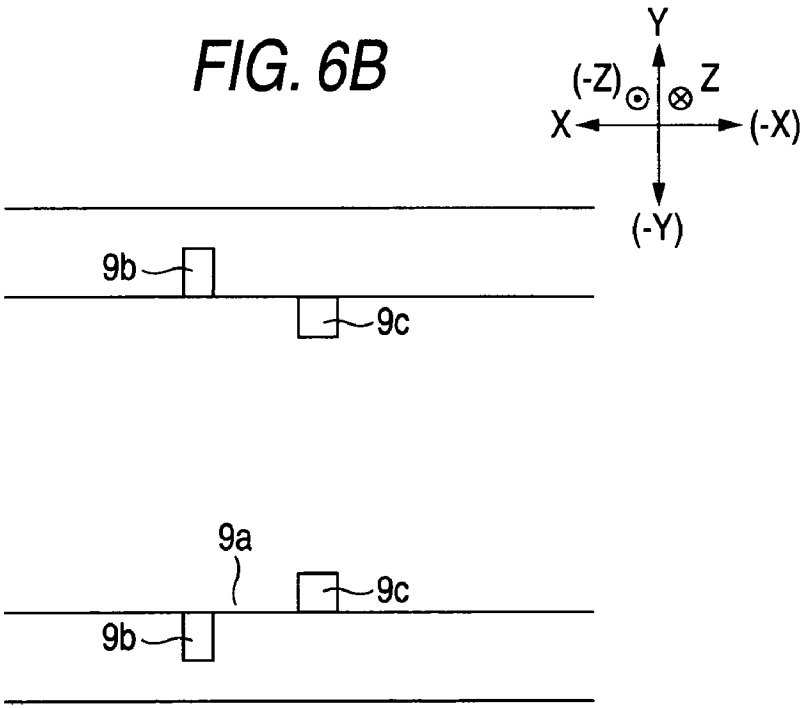
FIGS. 6A and 6B are views as viewed from the direction of arrow VIA in FIG. 5A.
Figure 6A:
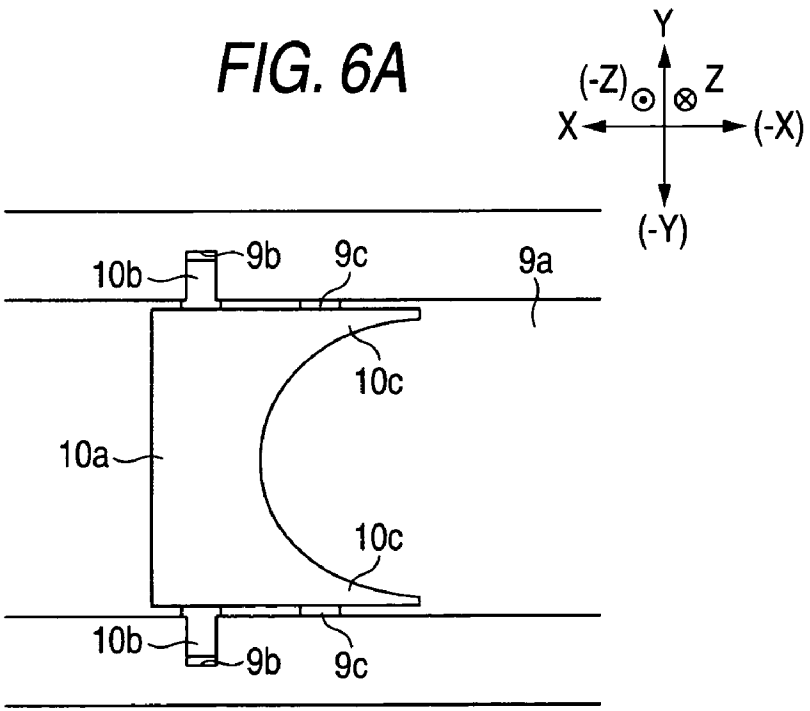

FIGS. 6A and 6B are views as viewed from the direction of arrow VIA in FIG. 5A. FIG. 6A illustrates a state that the developer damming member is held at a contained position, and FIG. 6B illustrates a state that the developer damming member is removed.

Figure 7B:
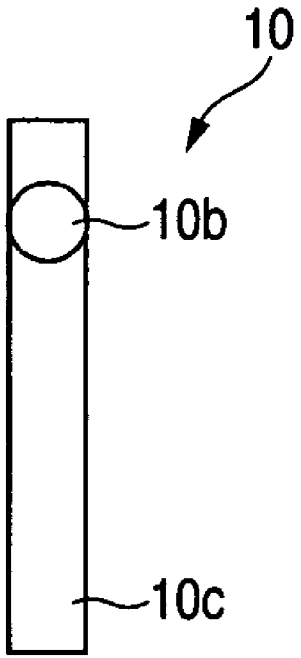
FIGS. 7A and 7B illustrate the developer damming member according to the first embodiment of the invention.
Figure 7A:
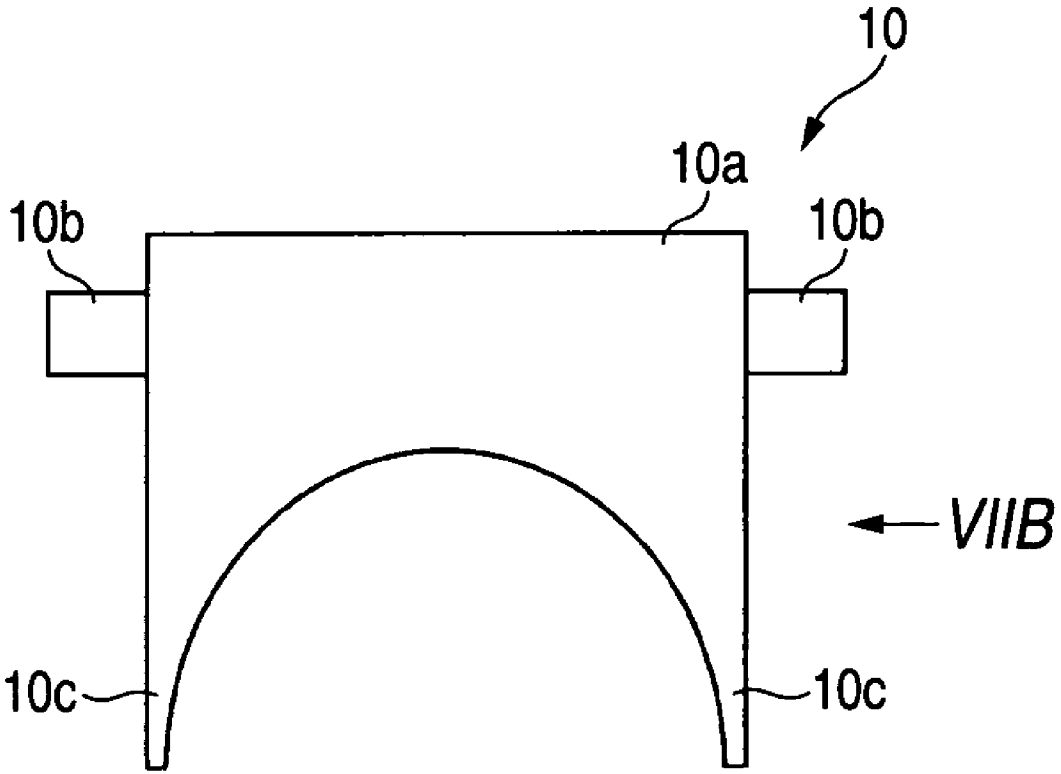

FIGS. 7A and 7B illustrate the developer damming member according to the first embodiment of the invention. FIG. 7A is a front view and FIG. 7B is a view as viewed from the direction of arrow VIIB in FIG. 7A.

As shown in FIGS. 3A and 3B, the lid member 1*b* is formed with an initial developer containing room 9 which is located over the second agitation transport room 4. As indicated by a broken line in FIG. 4, an opening 9*a* extending in the front-rear direction is formed at the lower end of the initial developer containing room 9. As shown in FIG. 4, the developer damming member 10 is disposed at a rear position of the initial developer containing room 9 (i.e., at a downstream position in the developer transport direction of the second agitation transport room 4) and is supported rotatably.

As shown in FIGS. 5-7, the developer damming member 10 has a plate-like damming member main body 10*a* and rotation shafts 10*b* which project in the right-left direction and are supported by the damming member main body 10*a* at positions close to its top. As shown in FIGS. 3A and 7A, the lower portion of the damming member main body 10*a* is formed with an agitation member surrounding portion 10*c* having a semicircular shape that conforms to the rotation locus of the transport blades 7*b* and 8*b* of the agitation transport members 7 and 8. That is, as shown in FIG. 5B, the agitation member surrounding portion 10*c* according to the first embodiment is formed to prevent developer from being transported along the wedge-shaped space between the second agitation transport member 8 and the second agitation transport room 4 (i.e., the shoulder portions above the second agitation transport member 8; indicated by a broken line in FIG. 5B) if the agitation member surrounding portion 10*c* is not provided.

The rotation shafts 10*b* of the developer damming member 10 are rotatably supported by a pair of (i.e., right and left) damming member support holes 9*b* as exemplary damming member support portions which are formed in the initial developer containing room 9 so as to be adjacent to the opening 9*a*, whereby the developer damming member 10 is supported so as to be able to swing between a damming position (indicated by a solid line in FIG. 5A) in the second agitation transport room 4 and a contained position (indicated by a broken line in FIG. 5A) in the initial developer containing room 9

As shown in FIGS. 5A and 5B, the developer damming member 10 according to the first embodiment is held at the damming position by its own weight. At the damming position, the developer damming member 10 is inclined so as to be come closer to the developer transport member as the position goes downstream in the developer transport direction. At the damming position, the angle θ formed by the damming member main body 10*a* and the rotary shaft 8*a* of the developer transport member (i.e., horizontal plane) is set an acute angle 60°. This angle may be changed arbitrarily according to the design etc.

In the first embodiment, it may be possible to dispose the rotation shafts 10*b* of the damming member 10 in the second agitation transport room 4. However, as the visible image forming device UK is made smaller (i.e., made thinner in the height direction), the interval between a film seal FS (described later) as a partition member/opening blocking member and the developer transport member becomes smaller and hence it becomes more difficult to secure, in the second agitation transport room 4, a space in which to dispose the rotation shafts 10*b*. In view of this, in the first embodiment, the rotation shafts 10*b* are disposed in the initial developer containing room 9.

A cylindrical developer transport room 11 is formed on the left of the second agitation transport room 4. A developer supply mouth 11*a* is formed at a position close to the front end of the developer transport room 11 so as to allow the developer transport room 11 to communicate with the second agitation transport room 4, and a developer inflow mouth 11*b* is formed at a position close to the rear end of the developer transport room 11. A developer supply member 12 for transporting the developer in the developer transport room 11 toward the developer supply mouth 11*a* is disposed in the developer transport room 11.

As for the developer supply member 12 according to the first embodiment, the diameter of a rotary shafts 12*a* is 4 mm, the spiral diameter (i.e., the outer diameter of a transport blade 12*b*) is 8 mm, the pitch which is the axial advancement per rotation of the transport blade 12*b* is 8 mm, and the rotation speed is set at 100 rpm. These values may be changed arbitrarily according to the design.

A first developer supply room 16 is formed on the left of the developer transport room 11, and a second developer supply room 18 which is connected to the first developer supply room 16 via developer drop passages 17 which are formed at both ends in the front-rear direction is disposed over the first developer supply room 16. A first developer transport member (developer supply member) 21 and a second developer transport member (developer supply member) 22 for transporting the developer in the first developer supply room 16 toward the developer inflow mouth 11*b* are disposed in the first developer supply room 16.

The first developer transport member 21 has a rotary shaft 21*a* and a transport thin-film member 21*b* which is a flexible resin thin-film made of PET (polyethylene terephthalate) or the like and is supported by the rotary shaft 21*a*. The transport thin-film member 21*b* is formed with cuts 21*c* which are inclined from the axial direction, and an auxiliary thin-film 23 for increasing the strength and thereby allowing the developer to flow toward the developer inflow mouth 11*b* more easily is stuck to the transport thin-film member 21*b* at such a position as to be opposed to the developer inflow mouth 11*b*. Therefore, while the first developer transport member 21 is rotating, the developer is transported toward the developer inflow mouth 11*b* (provided on the rear side) by the transport thin-film member 21*b* which is formed with the cuts 21*c*. The developer is then transported into the developer transport room 11 by the portion having the auxiliary thin-film 23.

The second developer transport member 22 transports the developer toward the first developer transport member 21. A third developer transport member (developer supply member) 24 and a fourth developer transport member (developer supply member) 26 which are disposed in the second developer supply room 18 transport the developer in the second developer supply room 18 toward the developer drop passages 17.

The developer transport room 11, the first developer supply room 16, and the second developer supply room 18 constitute a developer supply container (11+16+18) according to the first embodiment.

The photoreceptor body cleaner CLk is disposed on the right of the second developer supply room 18. The photoreceptor body cleaner CLk has a plate-like developer cleaning member (what is called a cleaning blade) 31 which is in contact with the surface of the photoreceptor body Pk and a collection developer transport member 33 for transporting, to a collection developer containing room 32, developer that has been scraped off by the cleaning blade 31.

As shown in FIG. 3B, the visible image forming device UK is provided with a film seal FS as an exemplary partition member/opening blocking member. An external end portion of the film seal FS is guided outside via a through-hole (not shown) formed in the visible image forming device UK and its internal end portion is divided into two parts. One part is stuck to the bottom surface of the boundary portion of the opening 9*a* in a state that the developer damming member 10 is located at the contained position, that is, the rotation shafts 10*b* are fitted in the damming member support holes 9*b* and the damming member main body 10*a* is in contact with the bottom surfaces of contained position restriction members 9*c*. As shown in FIG. 4, the other part of the internal end portion of the film seal FS is stuck to the wall so as to close the developer supply mouth 11*a* of the developer transport room 11.

Therefore, the opening 9*a* is closed and the initial developer containing room 9 is sealed by the film seal FS. Furthermore, sealing is made between the developer transport room 11 and the developer containing room (2-4).

In the first embodiment, a two-component developer (what is called an initial developer) in which a toner and a carrier are mixed together in advance at a preset, prescribed ratio is contained in the sealed initial developer containing room 9 and a toner as a supply developer is contained in the developer supply container (11+16+18). The developer containing room (2-4) is kept in a state that no developer exists there. Therefore, in a state that the film seal FS is attached, not only does no developer exist in the developer containing room (2-4) but also it is sealed. This prevents leakage of developer during transport or storage in a warehouse. The film seal FS is removed from the visible image forming device UK before the visible image forming device UK is attached to the image forming apparatus main body U1, whereupon the developer flows into the developer containing room (2-4) from the initial developer containing room 9 and supply of a developer from the developer supply container (11+16+18) is enabled.

The members etc. that are given symbols 1-26 and FS constitute the developer transport device according to the first embodiment.

Workings of Embodiment 1

In the printer U which has the above constituent features and is an exemplary image forming apparatus according to the first embodiment, when the visible image forming device UK is replaced, the film seal FS of a new visible image forming device UK is removed, whereupon the developer that has been sealed in the initial developer transport room 9 flows into the second agitation transport room 4 of the developer containing room (2-4). At this time, the developer damming member 10 is swung from the contained position to the damming position about the center line of the rotation shafts 10*b*.

The developer in the second agitation transport room 4 is transported by the agitation transport member 8 while being agitated by it. The developer is transported past the developer damming member 10 which is located at the position that is close to the downstream end in the developer transport direction.

At this time, since the transport passage for the developer in the second agitation transport room 4 is narrowed by the developer damming member 10, the upper portion of the developer is stopped by the developer damming member 10 and the developer is transported downstream at a rate corresponding to the cross section of the second agitation transport member 8 which is located under the developer damming member 10. The developer that is dammed up by the developer damming member 10 is agitated in such a manner as to form a local circulation together with developer that comes additionally in the wedge-shaped region formed between the developer damming member 10 and the second agitation transport member 8. In particular, lumps of cohered toner that have not sufficiently been reduced in size as they are transported along the second agitation transport room 4 are larger than toner that has been broken up sufficiently, and hence tend to go up as they are transported along the second agitation transport room 4. Therefore, they are dammed up effectively at the position of the developer damming member 10 and broken up through agitation.

The developer that has been agitated sufficiently by the developer damming member 10 is transported by the second agitation transport member 8, passes through the first agitation transport room 3., and is supplied to the developing roll G1*k*. Developer that has not been used for the development is again transported to the second agitation transport room 4 (circulatory transport).

As the toner is consumed by developments, additional toner is supplied from the developer supply container (11+16+18), transported and agitated by the second agitation transport member 8, further agitated by the developer damming member 10 which is located at the downstream position, and finally supplied to the developing roll G1*k*.

Example

Figure 8:
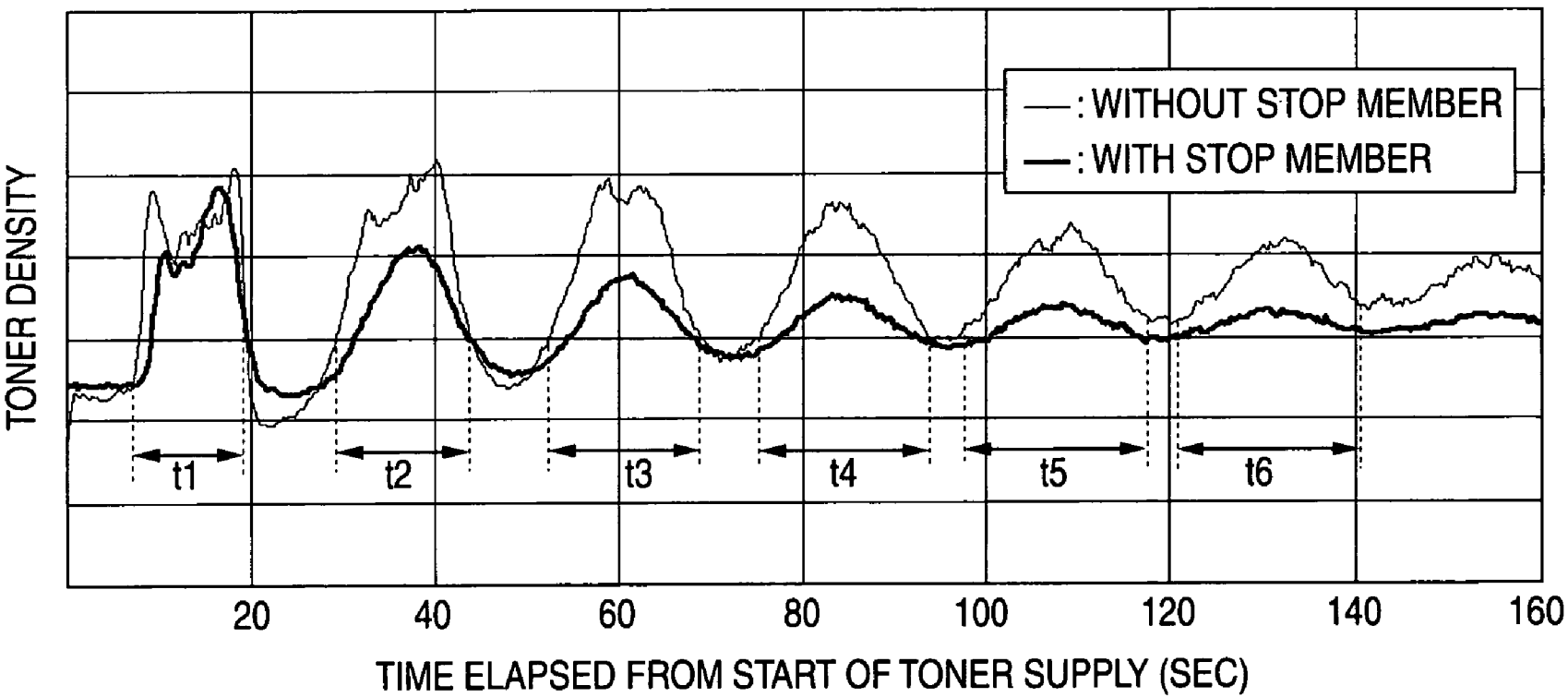
FIG. 8 is a graph in which the horizontal axis represents the time elapsed from the start of toner supply and the vertical axis represents the toner density, and illustrates an experiment of the first embodiment.

FIG. 8 is a graph in which the horizontal axis represents the time elapsed from the start of toner supply and the vertical axis represents the toner density, and illustrates an experiment of the first embodiment.

An experiment is conducted to check the effect of the developer damming member 10 according to the first embodiment. In the experiment, in the configuration according to the first embodiment, how the toner density detected by the toner density sensor SN2 varies depending on the presence/absence of the developer damming member 10 is measured when a set of toner supply of 0.5 sec and supply suspension of 0.5 sec is repeated ten times consecutively. FIG. 8 shows a result of the experiment.

As shown in FIG. 8, when a developer that has been supplied by an operation that a set of toner supply of 0.5 sec and supply suspension of 0.5 sec is repeated ten times, that is, a supply operation of $(0.5+0.5)\times 10=10$ sec, has been transported by the second agitation transport member 8 and reaches the position of the toner density sensor SN2, large toner density values are detected during a first detection period t1. The developer is further transported along the first agitation transport room 3 and the second agitation transport room 4 in this order and again reaches the position of the toner density sensor SN2 after making a first circulation. As a result, large toner density values are detected again during a second detection period t2. In this manner, the developer is detected during a third detection period t3, a fourth detection period t4, . . . as it makes a second circulation, a third circulation, . . . .

The developer which is transported and circulated by the agitation transport members 7 and 8 is spread gradually as it is transported, whereby a high-toner-density portion becomes less likely to occur. As shown in FIG. 8, the peak toner density lowers gradually. In a state that the toner density exhibits a high peak, that is, the developer has not been spread much, the toner density of the developer that is supplied from the first agitation transport room 3 to the developing roll G1*y*, G1*m*, G1*c*, or G1*k* varies, as a result of which an image produced may have a deep color band or streak or, in the worst case, small lumps of toner that have not been broken up. If a process control is performed in a state that the toner density is varying, the density of a patch image also varies to lower the accuracy. Where the developer damming member 10 is provided, cohered toner is broken up through agitation and peaks of the toner density converge earlier, whereby the accuracy of a process control is increased.

Embodiment 2

Figure 9B:
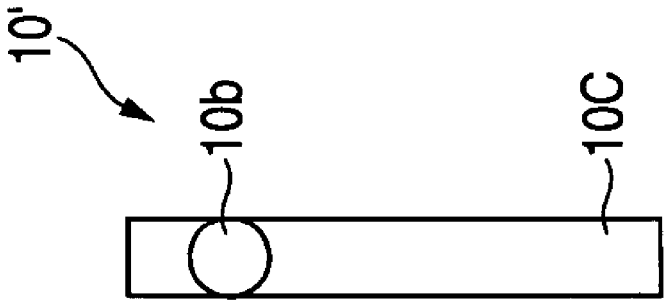
FIGS. 9A and 9B illustrate a developer damming member according to a second exemplary embodiment of the invention.
Figure 9A:
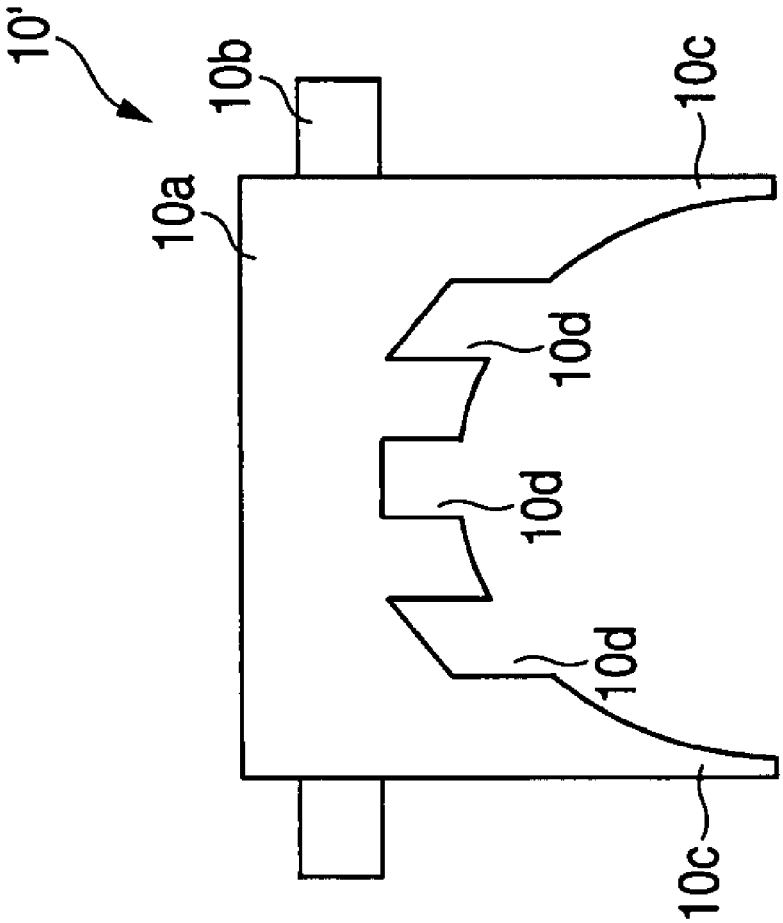

FIGS. 9A and 9B illustrate a developer damming member according to a second exemplary embodiment of the invention. FIGS. 9A and 9B are a front view and a side view corresponding to FIGS. 7A and 7B of the first embodiment, respectively.

Next, an image forming apparatus having the developer damming member according to the second embodiment of the invention will be described. In the description of the second embodiment, components having corresponding components in the first embodiment will be given the same reference symbols as the latter and will not be described in detail. The second embodiment is different from the first embodiment only in the following points.

As shown in FIGS. 9A and 9B, in the developer damming member 10' according to the second embodiment, a top portion of an agitation member surrounding portion 10*c* is formed with three passage grooves 10*d*.

Workings of Embodiment 2

In the image forming apparatus U according to the second embodiment having the above configuration, developer that has been transported to the position of the developer damming member 10' and has been dammed up by it is agitated because of being dammed up. Furthermore, the developer is pressed by developer coming additionally and is crushed by the passage grooves 10*d* in passing through them. In this manner, the developer is transported downstream after being broken up. Developer that has been agitated by the local circulation is further broken up due to a more turbulent flow. As such, the image forming apparatus U according to the second embodiment provides the same advantages as the image forming apparatus according to the first embodiment.

Embodiment 3

Figure 10A:
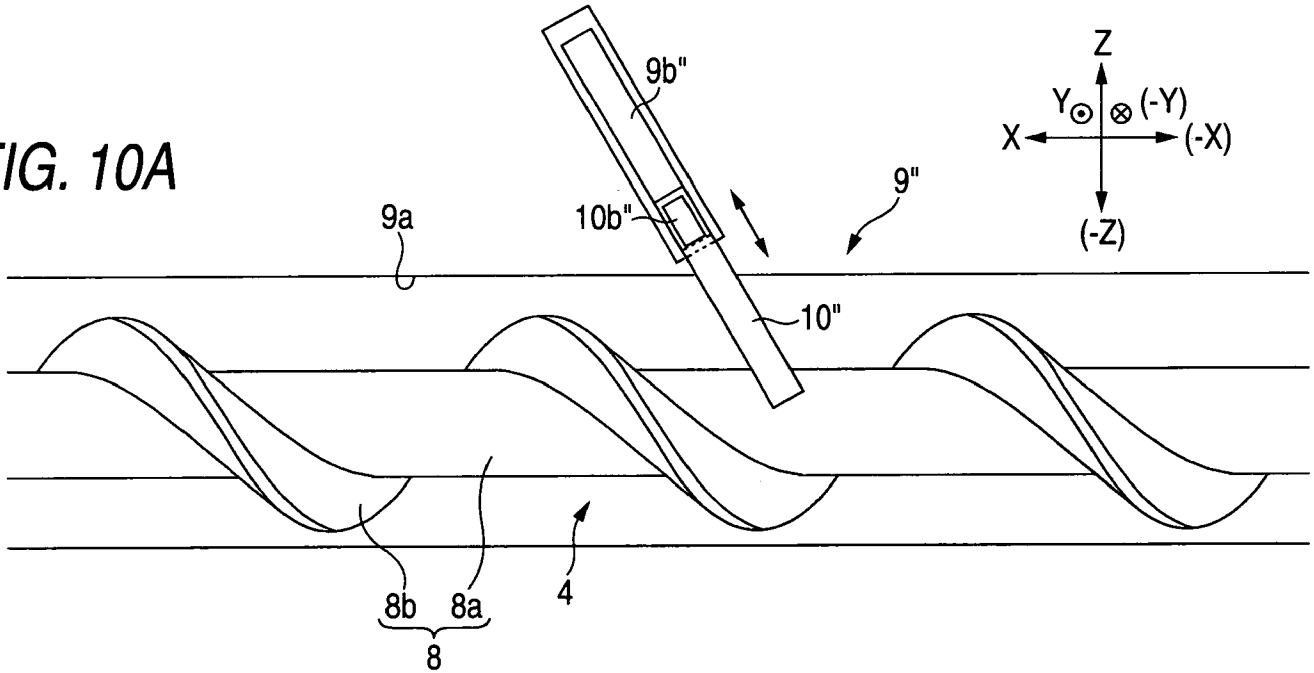
FIGS. 10A and 10B are a side view and a front view corresponding to FIGS. 5A and 7A of the first embodiment, respectively.
Figure 10B:
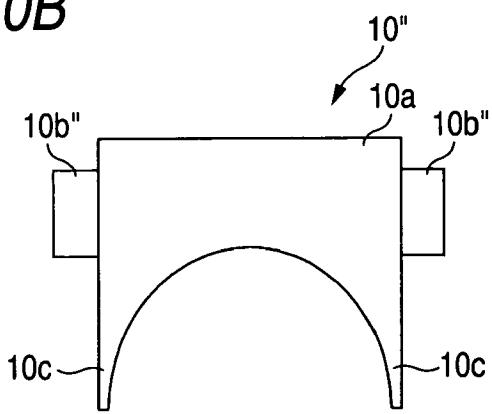

FIGS. 10A and 10B illustrate a developer damming member according to a third exemplary embodiment of the invention. FIGS. 10A and 10B are a side view and a front view corresponding to FIGS. 5A and 7A of the first embodiment, respectively.

Next, an image forming apparatus having the developer damming member according to the third embodiment of the invention will be described. In the description of the third embodiment, components having corresponding components in the first embodiment will be given the same reference symbols as the latter and will not be described in detail. The third embodiment is different from the first embodiment only in the following points.

As shown in FIG. 10, the developer damming member 10" according to the third embodiment has slide support receiving portions 10*b*" as exemplary support receiving portions instead of the rotation shafts 10*b*. An initial developer containing room 9" is configured correspondingly; that is, the damming member support holes 9*b* and the contained position restriction members 9*c* are omitted and, instead, a pair of (right and left) groove-shaped slide support portions 9*b*" as exemplary damming member support portions for supporting the respective slide support receiving portions 10*b*" are formed. Therefore, the developer damming member 10" can move slidingly from a contained position (not shown) where it is contained in the initial developer containing room 9" to a damming position shown in FIG. 10. That is, the developer damming member 10" is supported slidably.

Workings of Embodiment 3

In the image forming apparatus U according to the third embodiment having the above configuration, when the film seal FS has been removed, the developer damming member 10" is moved slidingly from the contained position to the damming position. Developer that has been transported to the developer damming member 10" which is located at the damming position is dammed up by the developer damming member 10" and agitated there. Furthermore, in the image forming apparatus U according to the third embodiment, even if receiving force from the developer, the developer damming member 10" that has been moved to the damming position effectively dams up and agitates the developer passing the position of the developer stop member 10" while being held at the stop position reliably. As such, the image forming apparatus U according to the third embodiment provides the same advantages as the image forming apparatus according to the first embodiment.

(Modifications)

The embodiments of the invention have been described above. However, the invention is not limited to the embodiments and various modifications are possible without departing from the spirit and scope of the invention described in the claims. Exemplary modifications H01-H08 of the invention will be described below.

(H01) The above embodiments are directed to the printers as exemplary image forming apparatus. However, the invention is not limited to printers and can be applied to facsimile machines, copiers, etc. as well as multi-function machines having all or part of those functions. Furthermore, the invention is not limited to multi-color-development type image forming apparatus and can be applied to single-color (monochrome) image forming apparatus.

(H02) In the above embodiments, the developer damming member 10, 10', or 10" is disposed in the second agitation transport room 4. However, the location of the developer damming member is not limited to the above position and it may be disposed at an arbitrary possible position according to the design. Plural developer damming members may be disposed in the second agitation transport room 4.

(H03) In the above embodiments, the developing device G and the developer supply container (11+16+18) are integrated with each other so as to be replaced together. However, the invention is not limited to such a configuration. A configuration is possible in which the developing device and the developer supply container are separated from each other and connected to each other by a developer transport member and developer is transported from the former to the latter.

(H04) In the second embodiment, the grooves 10*d* may be modified so as to have an arbitrary shape.

(H05) In the above embodiments, if the angle θ formed by the developer damming member 10 and the rotary shaft 8*a* of the agitation transport member 8 is set at an obtuse angle, the dammed developer tends to stay over the developer damming member 10 and is rendered stagnant. Therefore, it is desirable that the angle θ be set at an acute angle. However, it is possible to set it at an obtuse angle.

(H06) In the above embodiments, it is desirable to provide the agitation member surrounding portion 10*c*. However, it may be omitted.

(H07) In the above embodiments, each developer transport member is an auger having a rotary shaft and a spiral transport blade. However, the structure of each developer transport member is not limited to it. Developer transport members having arbitrary shapes may be used such as a developer transport member having a helical spring shape (coil spring shape) and a developer transport member in which semicircular transport blades are supported obliquely by a rotary shaft.

(H08) In the above embodiments, a developer which is a two-component developer containing a toner and a carrier is contained in the initial developer containing room 9 and only a toner is contained in the developer supply container (11+16+18). However, the invention is not limited to this configuration. A configuration is possible in which deteriorated developer is ejected little by little from each developing device and a high-density developer containing a carrier and a toner that is higher in density than the toner in each developing device is supplied to each developing device. Furthermore, the developer is not limited to the two-component developer and the invention can be applied to an image forming apparatus which uses a one-component developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transport device comprising:

a developer containing room for containing a developer;

a developer transport member disposed in the developer containing room, the developer transport member transporting the developer in a developer transport direction; and a developer damming member disposed in the developer containing room over the developer transport member, the developer damming member damming up the developer located above the developer transport member, wherein when the developer damming member disposed over the developer transport member is in a damming position and dams up the developer, the developer damming member is inclined in the developer transport direction.

2. The developer transport device according to claim 1, wherein the developer transport member rotates; and the developer damming member is shaped so as to surround a part of an outer circumference of a rotation locus of the developer transport member.

3. A developer transport device comprising:

a developer containing room for containing a developer;

a developer transport member disposed in the developer containing room, the developer transport member transporting the developer in a developer transport direction;

a developer damming member disposed in the developer containing room over the developer transport member, the developer damming member damming up the developer located above the developer transport member;

an initial developer containing room disposed above the developer containing room, for containing a developer; and partition member that separates the initial developer containing room and the developer containing room from each other, the partition member being removable, wherein the developer damming member is movable between a contained position where the developer damming member is contained inside the initial developer containing room and a damming position where the developer damming member is located in the developer containing room and dams up the developer; and the developer damming member is held at the contained position when the partition member is attached, and the developer flows from the initial developer containing room into the developer containing room and the developer damming member moves to the damming position when the partition member is removed.

4. The developer transport device according to claim 3, wherein the developer damming member is capable of swinging between the contained position and the damming position.

5. The developer transport device according to claim 3, wherein the developer damming member is capable of sliding between the contained position and the damming position.

6. The developer transport device according to claim 1, wherein the developer damming member is disposed at a position between a downstream end of a developer supply mouth through which a developer is supplied to the developer containing room and a developer holding body.

7. A developer transport device comprising: a developer containing room for containing a developer; a developer transport member disposed in the developer containing room, the developer transport member transporting the developer in a developer transport direction; and a developer damming member disposed in the developer containing room over the developer transport member, the developer damming member damming up the developer located above the developer transport member, and a lower surface portion of the developer damming member having a semicircular shape and including a passage groove through which a part of the developer passes.

8. A developing device characterized by comprising:

a developer containing room for containing a developer;

a developer transport member disposed in the developer containing room, the developer transport member transporting the developer in a developer transport direction;

a developer damming member disposed in the developer containing room over the developer transport member, the developer damming member damming up the developer located above the developer transport member; and a developer holding body that develops a latent image into a visible image with the developer transported, wherein, when the developer damming member disposed over the developer transport member is in a damming position and dams up the developer, the developer damming member is inclined in the developer transport direction.

9. A visible image forming device comprising:

an image holding body; and a developing device comprising:

a developer containing room opposed to a development region, for containing a developer;

a developer transport member disposed in the developer containing room, the developer transport member transporting the developer in a developer transport direction;

a developer damming member disposed in the developer containing room over the developer transport member, the developer damming member damming up the developer located above the developer transport member; and a developer holding body that develops a latent image into a visible image with the developer transported, wherein, when the developer damming member disposed over the developer transport member is in a damming position and dams up the developer, the developer damming member is inclined in the developer transport direction.

10. An image forming apparatus comprising:

an image holding body;

a developing device comprising:

a developer containing room opposed to a development region, for containing a developer, a developer transport member disposed in the developer containing room, the developer transport member transporting the developer in a developer transport direction, a developer damming member disposed in the developer containing room over the developer transport member, the developer damming member damming up the developer located above the developer transport member, and a developer holding body that develops a latent image into a visible image with the developer transported; and a transfer device that transfers the visible image on the image holding body to a transfer member, wherein, when the developer damming member disposed over the developer transport member is in a damming position and dams up the developer, the developer damming member is inclined in the developer transport direction.

11. A developer transport device comprising:

a developer containing room for containing a developer;

a developer transport member disposed in the developer containing room, the developer transport member transporting the developer in a developer transport direction; and a developer damming member that overhangs the developer transport member so as to narrow a transport passage of the developer being transported and dams up a part of the developer, wherein, when the developer damming member that overhangs the developer transport member is in a damming position and dams up the developer, the developer damming member is inclined in the developer transport direction.

* * * * *